US009086068B2

(12) United States Patent
Huang et al.

(10) Patent No.: US 9,086,068 B2
(45) Date of Patent: Jul. 21, 2015

(54) METHOD OF DETECTING SAFETY OF WATER HEATER

(75) Inventors: Chung-Chin Huang, Taichung (TW); Chin-Ying Huang, Taichung (TW); Hsin-Ming Huang, Taichung (TW); Hsing-Hsiung Huang, Taichung (TW); Kuan-Chou Lin, Taichung (TW); Yen-Jen Yen, Yunlin County (TW)

(73) Assignee: GRAND MATE CO., LTD., Taichung (TW)

( * ) Notice: Subject to any disclaimer, the term of this patent is extended or adjusted under 35 U.S.C. 154(b) by 742 days.

(21) Appl. No.: 13/235,199

(22) Filed: Sep. 16, 2011

(65) Prior Publication Data

US 2013/0071261 A1 Mar. 21, 2013

(51) Int. Cl.

| | |
|---|---|
| ***F04D 27/00*** | (2006.01) |
| ***F23N 3/08*** | (2006.01) |
| ***F23N 5/24*** | (2006.01) |

(52) U.S. Cl.

CPC ..... *F04D 27/00* (2013.01); *F23N 3/082* (2013.01); *F23N 5/242* (2013.01); *F23N 2031/20* (2013.01); *F23N 2033/08* (2013.01)

(58) Field of Classification Search

CPC ..... F23N 5/242; F04D 27/00
USPC ..... 431/2, 6, 12, 18, 89, 90; 122/14.1; 417/63

See application file for complete search history.

(56) References Cited

U.S. PATENT DOCUMENTS

| | | | | |
|---|---|---|---|---|
| 3,630,496 | A | 12/1971 | Hurst et al. | |
| 4,501,261 | A | 2/1985 | Tsutsui et al. | |
| 4,543,056 | A * | 9/1985 | Sakakibara | 431/76 |
| 4,706,881 | A | 11/1987 | Ballard | |
| 4,727,826 | A | 3/1988 | Draper et al. | |
| 4,792,089 | A | 12/1988 | Ballard | |
| 4,854,378 | A | 8/1989 | Zappia | |
| 4,856,982 | A * | 8/1989 | Olson | 431/20 |
| 4,860,231 | A | 8/1989 | Ballard et al. | |
| 4,866,633 | A * | 9/1989 | Nakane et al. | 700/282 |
| 4,872,443 | A | 10/1989 | Ruark | |
| 4,881,948 | A * | 11/1989 | Nakane et al. | 48/192 |
| 4,892,064 | A | 1/1990 | Zappia | |
| 4,893,113 | A * | 1/1990 | Park et al. | 340/632 |
| 4,905,511 | A | 3/1990 | Reinhold | |

(Continued)

OTHER PUBLICATIONS

Office Action, dated Dec. 27, 2013, regarding U.S. Appl. No. 12/954,444, 18 pages.

(Continued)

*Primary Examiner* — Gregory Huson
*Assistant Examiner* — Nikhil Mashruwala
(74) *Attorney, Agent, or Firm* — Tracy M Heims; Apex Juris, Pllc

(57) ABSTRACT

The present invention provides a method of detecting water heater safety, wherein the water heater includes a blower and a combustor. The method includes starting the blower and detecting blower speed after a certain amount of time; comparing the blower speed with a first speed range, and then supplying gas to the combustor when the speed of the blower is within the first speed range, or providing an alarm when the blower speed is beyond the first speed range; detecting the speed of the blower again after the combustor heats water for a time; comparing blower speed with a second first speed range, and then supplying gas to the combustor when the blower speed is within the second speed range, or stopping gas when the blower speed is beyond the second speed range.

12 Claims, 6 Drawing Sheets

(56) References Cited

U.S. PATENT DOCUMENTS

| | | | | |
|---|---|---|---|---|
| 4,909,190 | A * | 3/1990 | Finch | 122/1 A |
| 5,090,476 | A * | 2/1992 | Immel | 165/122 |
| 5,126,934 | A * | 6/1992 | MacFadyen | 700/11 |
| 5,199,385 | A | 4/1993 | Doss | |
| 5,255,665 | A | 10/1993 | Windon | |
| 5,429,059 | A | 7/1995 | Wagoner et al. | |
| 5,458,011 | A * | 10/1995 | Thompson | 73/865.9 |
| 5,526,776 | A | 6/1996 | Fenn et al. | |
| 5,601,071 | A * | 2/1997 | Carr et al. | 126/116 A |
| 5,658,140 | A * | 8/1997 | Kondou et al. | 431/90 |
| 5,865,611 | A | 2/1999 | Maiello | |
| 5,902,098 | A | 5/1999 | Park | |
| 6,039,261 | A | 3/2000 | Pavese | |
| 6,273,009 | B1 | 8/2001 | Magnussen | |
| 6,401,669 | B1 | 6/2002 | Macgowan et al. | |
| 6,612,267 | B1 | 9/2003 | West | |
| 6,694,926 | B2 * | 2/2004 | Baese et al. | 122/14.2 |
| 6,728,600 | B1 | 4/2004 | Contaldo et al. | |
| 6,755,138 | B2 | 6/2004 | McCarren | |
| 7,222,591 | B1 * | 5/2007 | Peart et al. | 122/14.31 |
| 7,647,895 | B2 * | 1/2010 | Donelly et al. | 122/14.21 |
| 7,814,868 | B2 | 10/2010 | Yin et al. | |
| 8,011,921 | B2 * | 9/2011 | Kim | 431/12 |
| 8,140,296 | B2 * | 3/2012 | Francino et al. | 702/182 |
| 8,381,689 | B2 * | 2/2013 | Huang et al. | 122/14.22 |
| 8,442,696 | B2 * | 5/2013 | Yokohata et al. | 700/282 |
| 8,522,815 | B2 * | 9/2013 | Honda et al. | 137/459 |
| 8,535,050 | B2 | 9/2013 | Kuroda | |
| 8,558,493 | B2 * | 10/2013 | Woodward | 318/400.3 |
| 8,591,221 | B2 * | 11/2013 | Schultz | 431/12 |
| 2002/0108440 | A1 | 8/2002 | Colman et al. | |
| 2002/0124992 | A1 | 9/2002 | Rainer et al. | |
| 2002/0150850 | A1 | 10/2002 | Kim et al. | |
| 2003/0131804 | A1 | 7/2003 | Iwama et al. | |
| 2005/0159844 | A1 | 7/2005 | Sigafus et al. | |
| 2005/0159845 | A1 | 7/2005 | Malone et al. | |
| 2005/0274328 | A1 * | 12/2005 | Baese et al. | 122/14.1 |
| 2006/0101838 | A1 | 5/2006 | Ritchey | |
| 2007/0099134 | A1 | 5/2007 | Hamada et al. | |
| 2008/0044778 | A1 | 2/2008 | Kuroda | |
| 2008/0078337 | A1 | 4/2008 | Donnelly et al. | |
| 2008/0124667 | A1 * | 5/2008 | Schultz | 431/18 |
| 2008/0138750 | A1 | 6/2008 | Kim | |
| 2008/0223943 | A1 | 9/2008 | Mulhouse et al. | |
| 2008/0288198 | A1 | 11/2008 | Francino et al. | |
| 2008/0314062 | A1 | 12/2008 | Ritchey | |
| 2009/0044794 | A1 * | 2/2009 | Hugghins et al. | 126/116 A |
| 2009/0293867 | A1 | 12/2009 | Chian et al. | |
| 2009/0297997 | A1 | 12/2009 | Chian et al. | |
| 2010/0095905 | A1 | 4/2010 | Smelcer | |
| 2010/0112500 | A1 * | 5/2010 | Maiello et al. | 431/76 |
| 2010/0116223 | A1 | 5/2010 | Tsuji et al. | |
| 2010/0116225 | A1 | 5/2010 | Smelcer | |
| 2010/0195991 | A1 | 8/2010 | Deivasigamani et al. | |
| 2010/0255434 | A1 | 10/2010 | Kim | |
| 2010/0330515 | A1 * | 12/2010 | Ueki et al. | 431/22 |
| 2011/0048342 | A1 | 3/2011 | Vroom | |
| 2011/0259446 | A1 * | 10/2011 | Ueki et al. | 137/487.5 |
| 2012/0037096 | A1 | 2/2012 | Watanabe et al. | |
| 2012/0115095 | A1 | 5/2012 | Chian et al. | |
| 2012/0125268 | A1 | 5/2012 | Huang et al. | |
| 2013/0145782 | A1 | 6/2013 | Ritchey | |
| 2013/0284116 | A1 | 10/2013 | Deivasigamani et al. | |
| 2013/0284117 | A1 | 10/2013 | Deivasigamani et al. | |
| 2013/0312671 | A1 | 11/2013 | Deivasigamani et al. | |

OTHER PUBLICATIONS

Office Action, dated Jul. 8, 2014, regarding U.S. Appl. No. 12/954,444, 17 pages.

Office Action, dated Dec. 29, 2014, regarding U.S. Appl. No. 12/954,444, 20 pages.

* cited by examiner

METHOD OF DETECTING SAFETY OF WATER HEATER

BACKGROUND OF THE INVENTION

1. Field of the Invention

The present invention relates generally to a water heater, and more particularly to a method of detecting safety of a water heater.

2. Description of the Related Art

A conventional water heater exhausting gas after burning by nature convection is very dangerous to be mounted indoors since carbon monoxide generated from the water heater is fatal when the gas is accumulated in the rooms.

An improved water heater, direct vent/power vent water heater, was provided, in which a blower is provided to exhaust the gas after burning, including carbon monoxide, out of the rooms and to raise the burning efficiency as well. The blower may provide more air for burning to generate more heat.

However, jam or aging of the blower causes a poor ventilation of air in the water heater that burning will generate more carbon monoxide. However, user may think he/she is safe with the direct vent water heater without being aware that it is still dangerous with the water heater having a jammed or aged blower.

SUMMARY OF THE INVENTION

The primary objective of the present invention is to provide a method of detecting safety of a water heater, which detects the speed of the blower before heating, in heating, and after heating to ensure the safety of the water heater.

According to the objective of the present invention, the present invention provides a method of detecting safety of a water heater, wherein the water heater includes a blower and a combustor. The method includes the following steps:

A. Start the blower and detect a speed of the blower after the blower has run for a time; and B. Comparing the speed of the blower with a first speed range, and then supply gas to the combustor when the speed of the blower is within the first speed range, or provide an alarm when the speed of the blower is beyond the first speed range.

In an embodiment, the method of the present invention further includes the step of detecting a speed of the blower again after the combustor heats water for a time, and then comparing the speed of the blower with a second first speed range, and then supplying gas to the combustor when the speed of the blower is within the second speed range, or stopping gas when the speed of the blower is beyond the second speed range.

In an embodiment, the present invention further provides a method of detecting safety of a water heater after the water heater is turned off. The method includes the following steps:

A. Keep the blower to run for a time, and then detect a speed of the blower; and B. Compare the speed of the blower with a third speed range, and then turn off the blower after a predetermined time when the speed of the blower is within the third speed range, or providing an alarm when the speed of the blower is beyond the third speed range.

As a result, we may obtain the function of the water heater by detecting the speed of the blower.

DETAILED DESCRIPTION OF THE INVENTION

Figure 1:
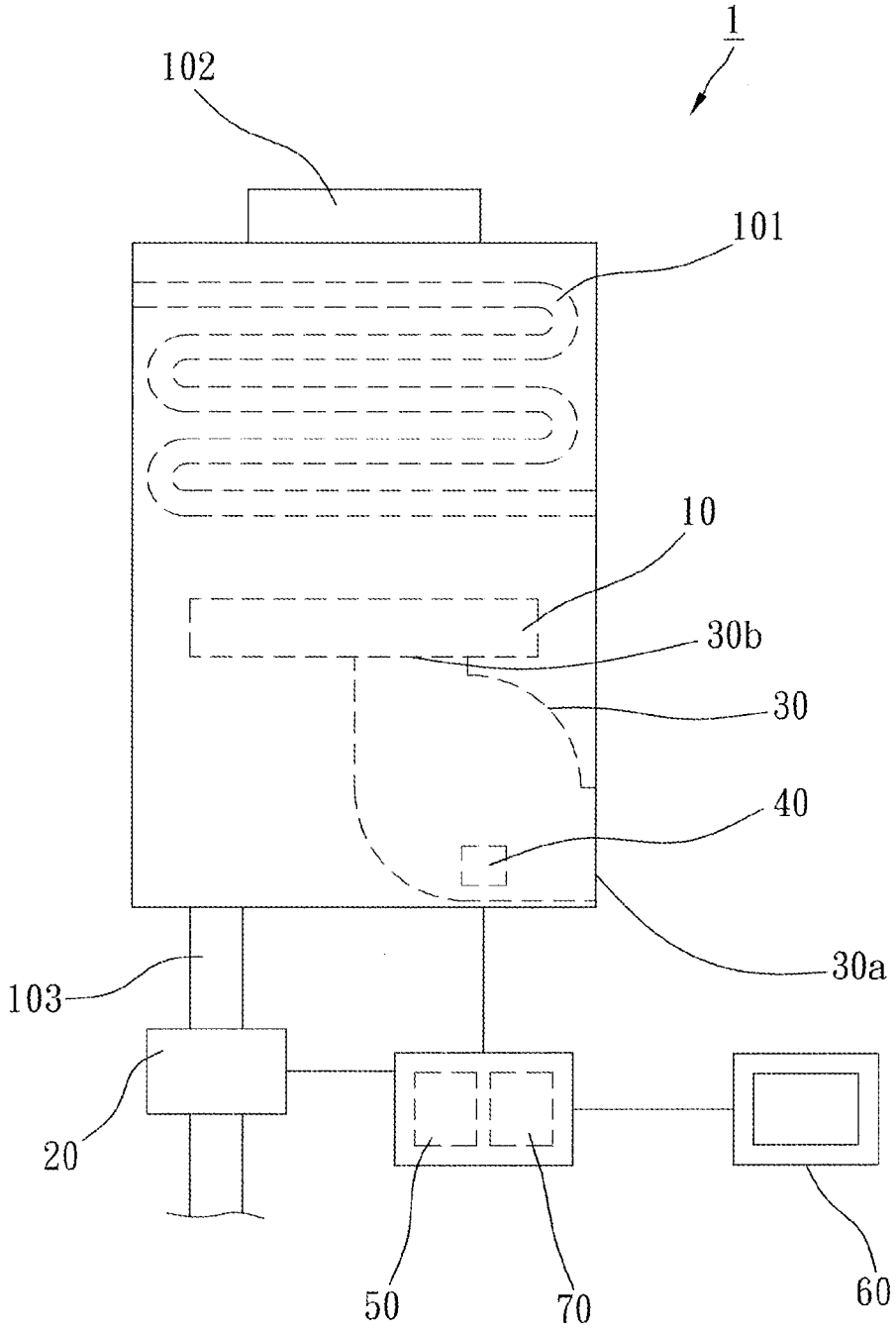
FIG. 1 is a sketch diagram of the water heater of the present invention.

As shown in FIG. 1, a water heater 1 applied in a method of safety detection of the preferred embodiment of the present invention includes a combustor 10, a valve 20, a blower 30, a detecting device 40, a processor 50, and an alarming device 60.

The combustor 10 is under a water pipe 101 to heat water in the water pipe 101. An exhaust pipe 102 is provided to exhaust waste gas of the combustor 10 after burning.

The valve 20 is mounted on a gas pipe 103 to adjust the gas flow. The valve 20 is a conventional device, for example, the valve may be the device taught by U.S. Publication no. 20090206291A1 which controls the gas flow rate by current, or other devices serving the same function.

The blower 30 is under the combustor 10 to provide an air flow into the water heater 1 via an inlet 30*a* and blow it to the combustor 10 through an outlet 30*b*. The blower 30 helps the mixing of air and gas. The blower 30 is provided with a motor (not shown) therein. It is known that the speed of the motor is directly proportional to the air flow supplied to the combustor 10. In other words, the higher the speed of the blower 30 is, the more air is supplied to the combustor 10. On the contrary, the lower the speed of the blower 30 is, the less air is supplied to the combustor 10.

The detecting device 40 is provided in the blower 30 to detect the speed of the motor.

Figure 2:
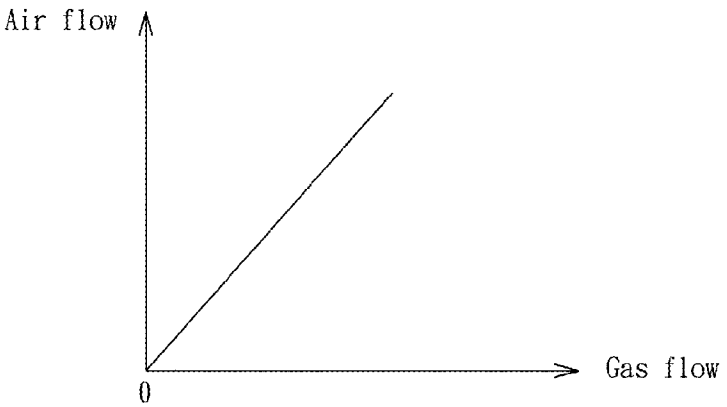
FIG. 2 is a curve diagram showing the relationship between the air flow and the gas flow.

The processor 50 is electrically connected to the detecting device 40. The processor 50 is stored with a first theoretical speed and a second theoretical speed. The first theoretical speed indicates an expected speed of the blower 30 before the water heater 1 starts to heat water and the blower 30 has run for a time. As shown in FIG. 2, the second theoretical speed indicates an expected speed of the blower 30 when the combustor 10 burns under an optimal air-gas ratio. It is based on the gas flow rate through the valve 20 and the air flow provided by the blower 30.

Figure 3:
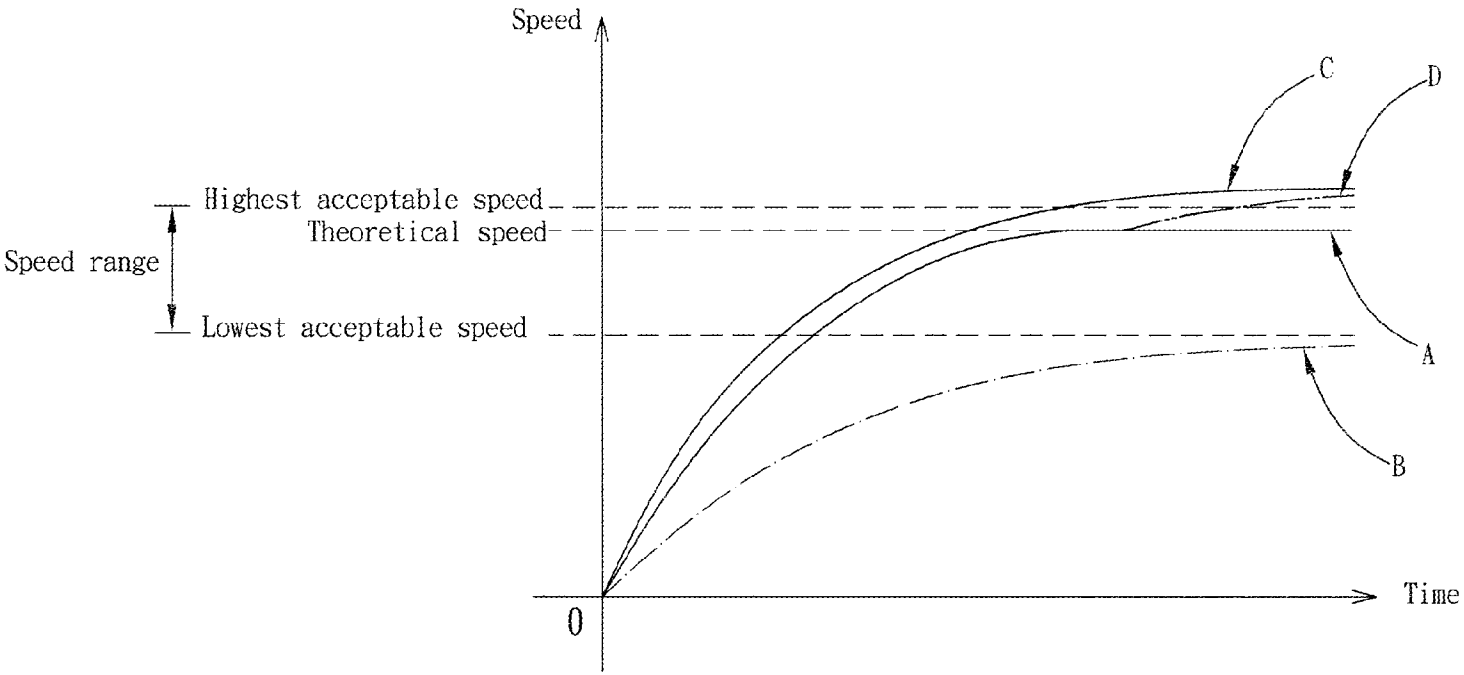
FIG. 3 is a curve diagram showing the speed of the motor.

As shown in FIG. 3, the line A shows the motor running normally, and its speed approaching the theoretical speed. It is known that efficiency the blower 30 will decrease after a time of use, we call it aging, that the air flow supplied to the combustor 10 is insufficient when the blower 30 is supplied with the same power as usual. For this, we define a lowest acceptable speed, shown as the line B, under which the combustor 10 may have incomplete combustion. In regard of an abnormal blower, such as its exhaust passageway is jammed, the inner pressure of such blower is very high that it needs to increase the air compensation. Such blower will have an extreme high speed in starting and in running (shown as the line C and the line D). This extreme high speed is defined as a highest acceptable speed. The water heater will be in danger of carbon monoxide when the speed of the blower is higher than the highest acceptable speed. In the present invention, the lowest acceptable speed is set as 0.7 times of the theoretical speeds, and the highest acceptable speed is set as 1.04 times of the theoretical speeds.

A first speed range is a speed range between a first highest acceptable speed and a first lowest acceptable speed, both of which are derived from the first theoretical speed, and a second speed range is a speed range between a second highest acceptable speed and a second lowest acceptable speed, both of which are derived from the first theoretical speed. It is noted that the exact values of the highest and lowest acceptable speeds and the first and second theoretical speed are different because of the model of the motor. The one is skilled in the art may be easy to set up these speeds in manufacture of the water heater according to the specification of the motor.

The alarming device 60 may provide an alarm in sound, light, or others, such as "The blower is aged", "The blower is jammed" to warn user.

Figure 4:
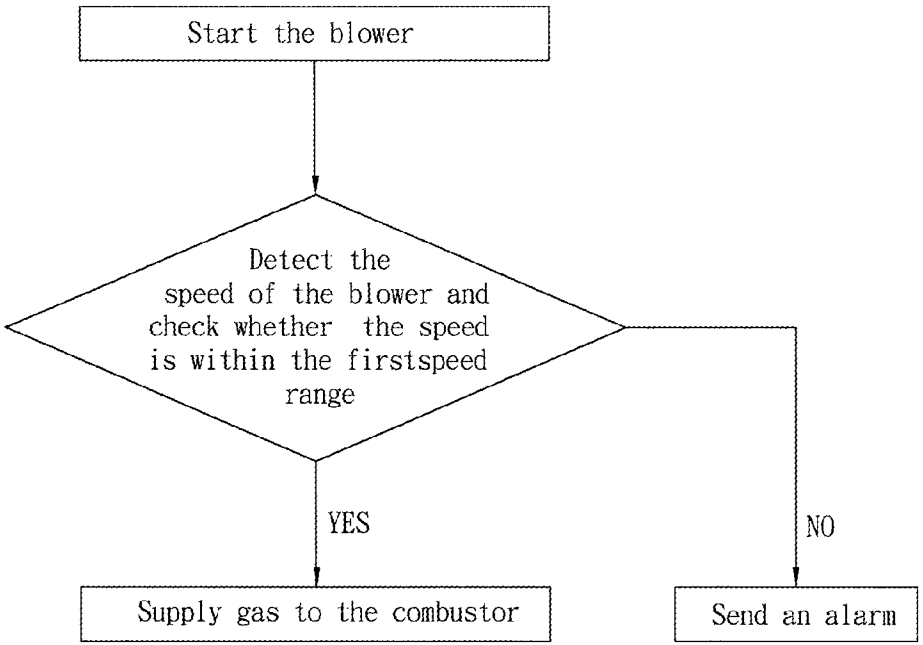
FIG. 4 is a flow chart of the safety detection before heating of a preferred embodiment of the present invention.

As shown in FIG. 4, when the water heater 1 is started, such as open the faucet, a method of detecting safety of the present invention is performed automatically. The method includes:

A. Start the blower 30 to exhaust waste gas, such as carbon monoxide, and then detect a speed of the blower 30 after a predetermined time.

B. Compare the speed of the blower 30 with the first speed range by the processor 40, and Open the valve 20 to supply gas when the speed of the blower 30 is within the first speed range; or Start the alarming device 60 to provide an alarm to warn user that the water heater 1 is abnormal when the speed of the blower 30 is beyond the first speed range.

Figure 5:
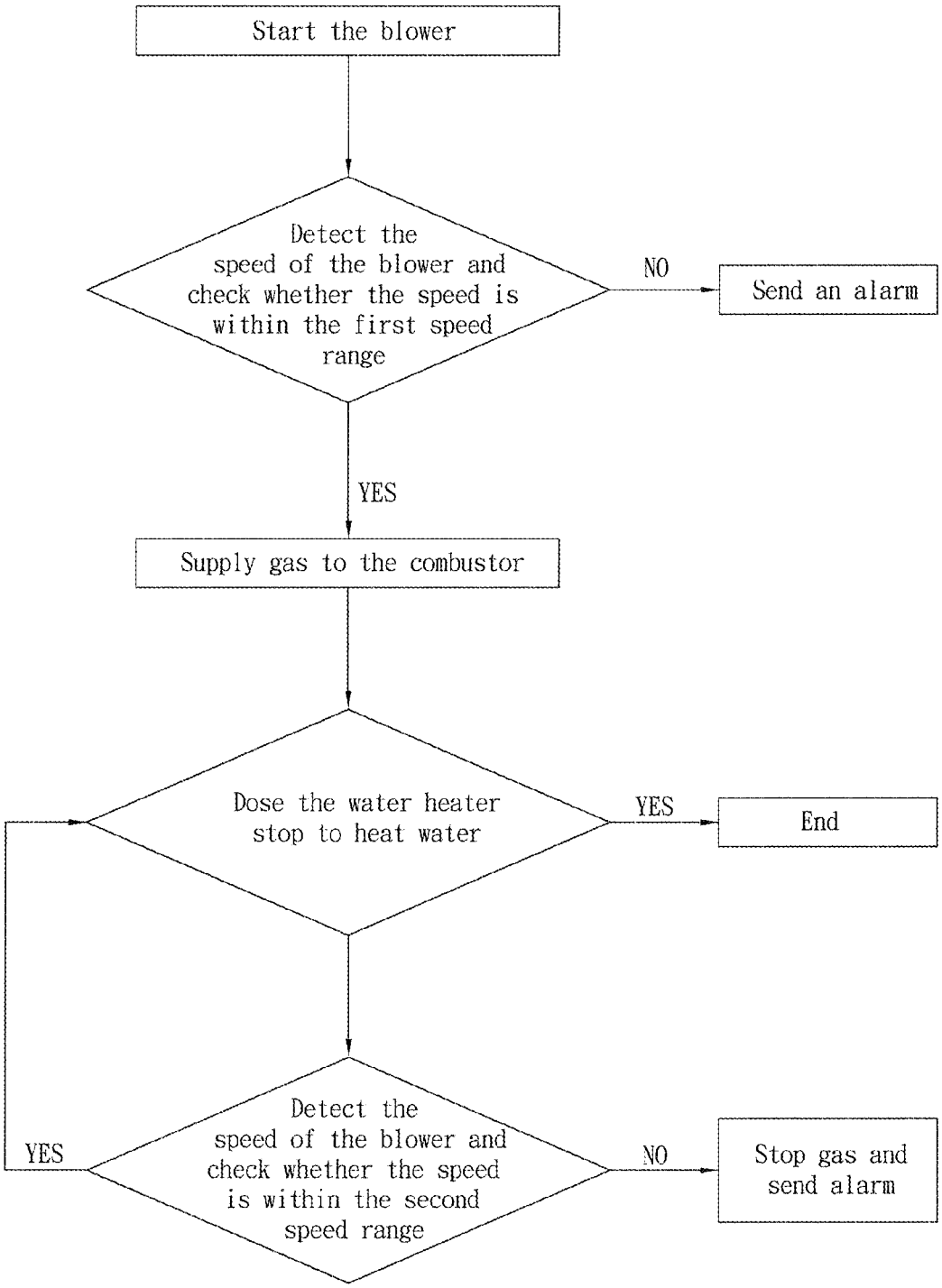
FIG. 5 is a flow chart of the safety detection in heating based on the procedures of FIG. 4.

As shown in FIG. 5, the present invention further provides a step after the step B, which is C. Detect the speed of the blower 30 by the detecting device 40 after the combustor 10 heats water to a preset temperature, and then compare the speed with the second speed range by the processor 50, and Keep supplying gas to the combustor 10 and repeat the step C when the speed is within the second speed range until the water heater 1 is turned off; or Close the valve 20 to stop the gas, and activate the alarming device 60 to provide an alarm.

The water heater may be provided with a delay controller 70 electrically connected to the blower 30 to keep the blower 30 to run for a time after the water heater 1 is turned off (close the faucet) that the blower 30 may exhaust the waste gas remained in the water heater for safety.

Figure 6:
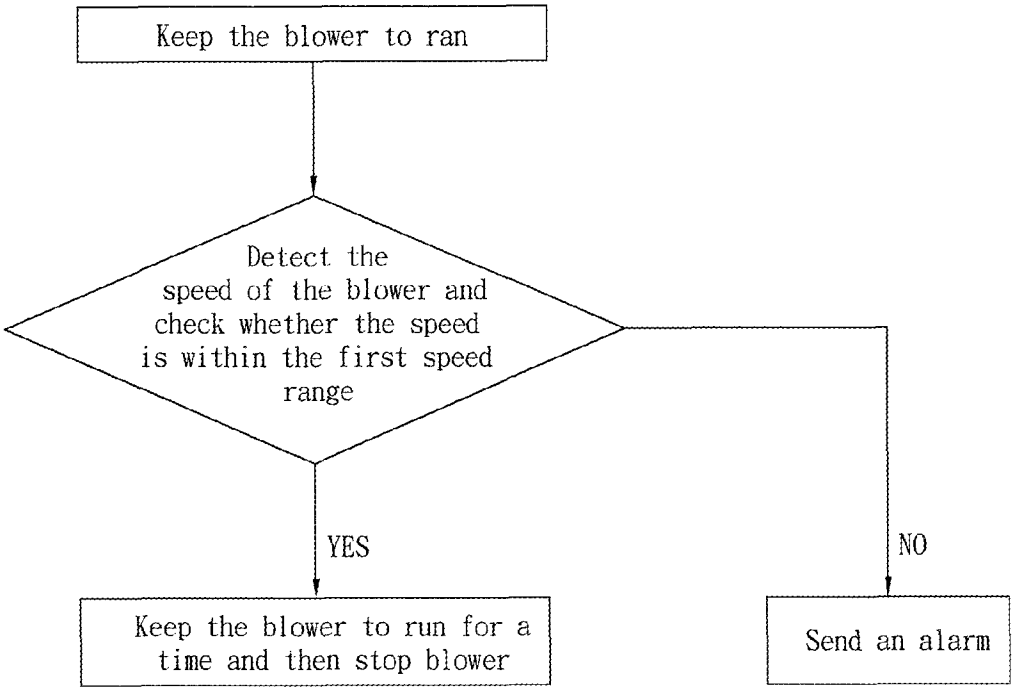
FIG. 6 is a flow chart of safety detection after heating of the preferred embodiment of the present invention.

The present invention further provides a detection method after the water heater is turned off. As shown in FIG. 6, the processor 40 is stored with a third theoretical speed. The third theoretical speed indicates an expected speed of the blower 30 after the water heater is turned off and the blower 30 is still running for a time. As shown in FIG. 3, it may get a third speed range between a third lowest acceptable speed, which is 0.7 times of the third theoretical speed, and a third highest acceptable speed, which is 1.04 times of the third theoretical speed. Therefore, the method includes the following steps:

A. Keep the blower 30 to run for a time, and then detect the speed of the blower 30 by the detecting device 40.

B. Compare the speed with the third speed range by the processor 50, and

Keep the blower 30 to run for a time and turn it off by the delay controller 70; when the speed is within the third speed range or Stop the blower 30 at once, and activate the alarming device 60 to provide an alarm when the speed is beyond the third speed range.

In conclusion, the present invention provides a safety detection method to detect the speed of the blower of the water heater before heating, in heating, and after heating. It may detect weather the water heater is normally running in a fast way to provide a safety use at home.

The description above is a few preferred embodiments of the present invention and the equivalence of the present invention is still in the scope of claim construction of the present invention.

What is claimed is:

1. A method of detecting safety of a water heater, wherein the water heater includes a blower and a combustor, the method comprising the steps of:

A. starting the blower, and detecting a speed of the blower after the blower has run for a time wherein gas is not supplied yet;

B. comparing the speed of the blower with a first speed range, and then start supplying gas to the combustor when the speed of the blower is within the first speed range, or not supplying gas and stopping the blower when the speed of the blower is beyond the first speed range; and C. detecting a speed of the blower again after the combustor heats water for a certain amount of time, and comparing the speed of the blower with a second speed range, and then continuing to supply gas to the combustor and keeping the speed of the blower when the speed of the blower is within the second speed range, or stopping to supply gas when the speed of the blower is beyond the second speed range;

wherein a first theoretical speed falls in the first speed range, and the first theoretical speed is an expected speed of the blower before the combustor starts to heat water, and the blower has run for a certain amount of time;

wherein a second theoretical speed falls in the second speed range, and the second theoretical speed is an expected speed of the blower when the combustor burns under an optimal air-gas ratio;

wherein the first speed range is between a first lowest acceptable speed and a first highest acceptable speed of the blower before ignition; and wherein the second speed range is between a second lowest acceptable speed and a second highest acceptable speed of the blower while the combustor is burning gas.

2. The method as defined in claim 1, wherein the first lowest acceptable speed is 0.7 times of the first theoretical speed.

3. The method as defined in claim 1, wherein the first highest acceptable speed is 1.04 times of the first theoretical speed.

4. The method as defined in claim 1, wherein the second lowest acceptable speed is 0.7 times of the second theoretical speed.

5. The method as defined in claim 1, wherein the second highest acceptable speed is 1.04 times of the second theoretical speed.

6. The method as defined in claim 1, further comprising the step of providing an alarm when the speed of blower is beyond the first speed range.

7. The method as defined in claim 1, further comprising the step of providing an alarm when the speed of blower is beyond the second speed range.

8. The method as defined in claim 1, further comprising the step of keeping the blower to run for a predetermined time after stopping supplying gas, and then turning off the blower automatically.

9. The method as defined in claim 1, further comprising the steps of:

A. keeping the blower to run for a time after the water heater stops supplying gas to the combustor, and then detecting a speed of the blower; and B. comparing the speed of the blower with a third speed range, and then turning off the blower after a predetermined time when the speed of the blower is within the third speed range, or providing an alarm when the speed of the blower is beyond the third speed range;

wherein a third theoretical speed falls in the third speed range, and the third theoretical speed is an expected speed of the blower after the water heater is turned off and the blower is still running for a predetermined time.

10. The method as defined in claim 9, wherein the third speed range is between a third lowest acceptable speed and a third highest acceptable speed.

11. The method as defined in claim 10, wherein the third lowest acceptable speed is 0.7 times of the third theoretical speed.

12. The method as defined in claim 10, wherein the third highest acceptable speed is 1.04 times of the third theoretical speed.

* * * * *